US011820619B2

(12) United States Patent
Carlson et al.

(10) Patent No.: US 11,820,619 B2
(45) Date of Patent: Nov. 21, 2023

(54) DECOUPLED SOLENOID AND PAWL FOR A DOOR-MOUNTED MULTI-PURPOSE FEEDER

(71) Applicant: LEXMARK INTERNATIONAL, INC., Lexington, KY (US)

(72) Inventors: Geoffrey Kirk Carlson, Lexington, KY (US); Darren Adam Keese, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 204 days.

(21) Appl. No.: 17/229,258

(22) Filed: Apr. 13, 2021

(65) Prior Publication Data

US 2021/0316954 A1 Oct. 14, 2021

Related U.S. Application Data

(60) Provisional application No. 63/009,416, filed on Apr. 13, 2020.

(51) Int. Cl.
*B65H 3/06* (2006.01)

(52) U.S. Cl.
CPC ..... *B65H 3/0669* (2013.01); *B65H 2402/45* (2013.01); *B65H 2403/724* (2013.01); *B65H 2403/73* (2013.01); *B65H 2601/321* (2013.01)

(58) Field of Classification Search
CPC ..... B65H 3/0669; B65H 2402/45; B65H 2403/72; B65H 2403/722; B65H 2403/724; B65H 2403/73; B65H 2601/321
See application file for complete search history.

(56) References Cited

U.S. PATENT DOCUMENTS 4,925,062 A * 5/1990 Tsukamoto ..... B65H 3/5261 271/118
5,201,873 A * 4/1993 Kikuchi ..... B65H 3/0669 271/9.13
5,642,952 A * 7/1997 Tomatsu ..... B41J 13/103 271/226
8,523,172 B2 * 9/2013 Kawamura ..... B65H 7/02 271/114

* cited by examiner

*Primary Examiner* — Justin N Olamit

(57) ABSTRACT

In the invention described, an actuating solenoid on one side of a printer wall connects to a pawl by a lever component. The lever has a pawl-actuating post extending through a wall window so that it may interface with a flared slot on the clutch's pawl. By extending the post through the wall window, space is saved when the printer door is closed because the solenoid does not need to be on the inside of the wall.

6 Claims, 12 Drawing Sheets

DECOUPLED SOLENOID AND PAWL FOR A DOOR-MOUNTED MULTI-PURPOSE FEEDER

CROSS REFERENCES TO RELATED APPLICATIONS

This application claims priority and benefit under 35 U.S.C. 119(e) from U.S. provisional application No. 63/009,416 titled "Door-Mounted Multi-Purpose Feeder," having a filing date of Apr. 13, 2020.

BACKGROUND

1. Field of the Invention

This invention relates generally to decoupling the control solenoid and the multi-purpose feeder ("MPF") pick roll clutch pawl in a printer so that the MPF pick roll can be mounted on an outer door.

2. Description of the Related Art

Typical existing solenoid and pawl clutch arrangements have disadvantages. A dual sector gear clutch, for example, is used on several known printers. In the dual sector gear clutch, a pawl interfaces with a cam on the clutch to hold the clutch in its home position, where it is not driven by its mating gear. When the pawl is momentarily pulled away from the cam by a solenoid, while a driving gear is turning, the clutch makes a single rotation and stops at its home position again. The pawl is typically released by solenoid and returned by a spring.

A spring-loaded lever could be used to lock the pawl or the gear clutch when the door is opened. A feature on a printer would release the lock when the door is closed. Such a design would require additional parts in comparison to a roller lock. Further, a lock that is actuated by a feature on the printer may be prone to manipulation and accidental release by the user and may exert forces on the door that make it more difficult to latch closed.

A solenoid with significantly more pull force and distance could be used to avoid the need for a lever that bidirectionally controls the pawl. Instead, the solenoid could directly push the pawl, and the pawl could have its own spring to return to position. The drawback of such a solenoid is significant added cost.

Finally, the cam on the gears and the pawl could be designed to lock rotation in both directions. However, this arrangement would require a spring to hold the pawl engaged. The solenoid would need to be powerful enough to resist the amount of spring force necessary to dissuade user manipulation, which would add significant cost.

SUMMARY OF THE INVENTION

Disclosed is an invention that reduces printer height (and therefore machine cost) by moving the MPF pick system onto the front door. By moving the pick system onto the door, excess space above the toner cartridge is not required for the cartridge to be able to clear the MPF pick module during insertion and extraction.

A further goal of keeping the solenoid that actuates each MPF pick cycle off the door and located on the printer frame. If the solenoid were mounted on the door, the wiring would need to be routed through a hinge, leading to assembly complexity and at least one extra part to shield the cable from the customer. Depending on which side's hinge the cable is routed through, there would either need to be a long covering piece over it or intermediate cable connectors to detach, either of which would add significant cost.

The goal of mounting the MPF pick module on the door must meet several challenges. First, there is significantly more total tolerance in the relative positions of the solenoid and the gear cam due to their mounting on separate printer modules. A higher range of motion of the solenoid to accommodate the tolerance would drive a higher solenoid cost.

Second, the mechanism must be able to re-engage and return to its home position, whether or not the gear clutch is in the home position when the door is closed. Finally, loss of the home position while the door is open should be avoided, because re-homing the MPF pick roll would cause a noisy dry pick or can partially feed the top sheet if any sheets are loaded.

A further advantage of the described invention is that in an S-path printer, a front guide is required above the primary media input tray to turn sheets from an upward direction out of the trays to a rearward direction across the top of the main frame. This guide position shields the paper around where it bends towards the rear of the printer. If there is a jam near the front of the printer, it is difficult for the customer to clear it, because either end of the paper is pointed away from the customer, such that the customer must pull the paper further into the printer or tray cavity. Transferring the MPF pick system onto the door provides an opportunity to resolve this issue.

BRIEF DESCRIPTION OF THE DRAWINGS

Figure 1:
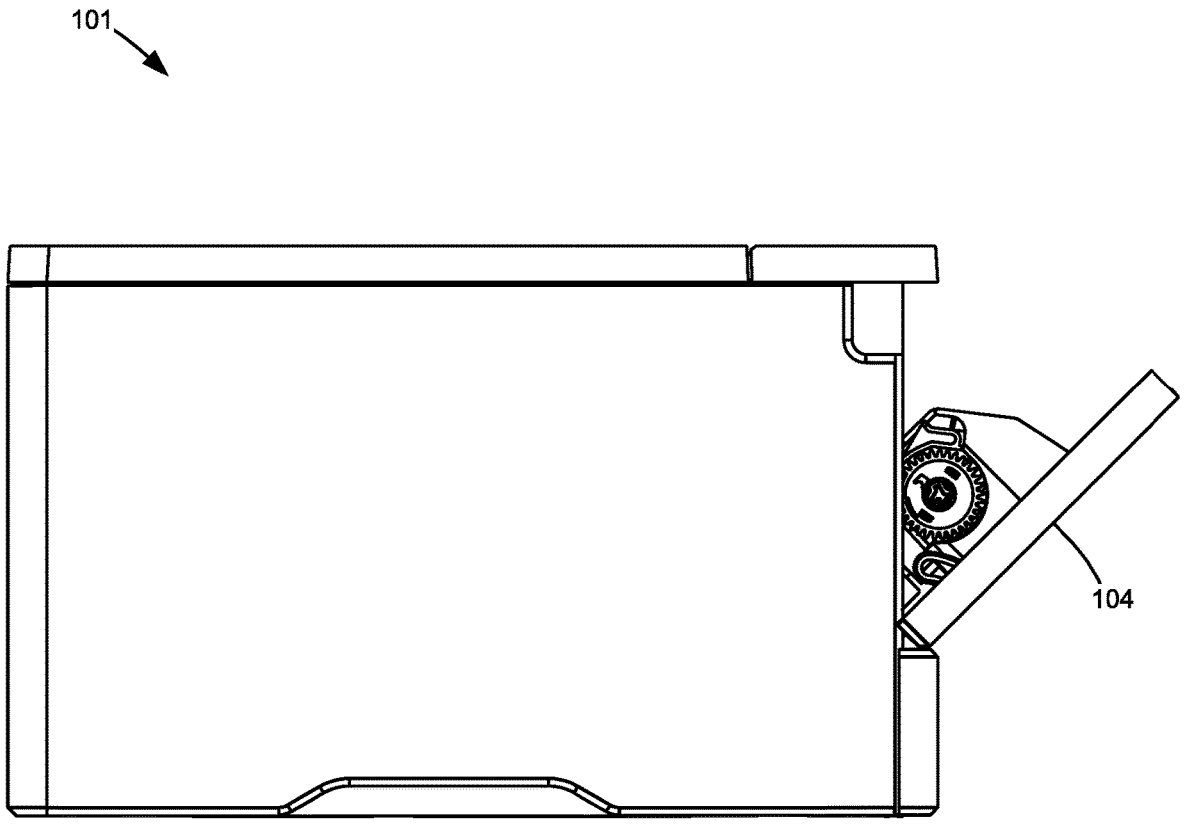

Having thus described the invention in general terms, reference will now be made to the accompanying drawings, which are not necessarily drawn to scale, and wherein:

FIG. 1 shows a printer with the door open.

Figure 1A:
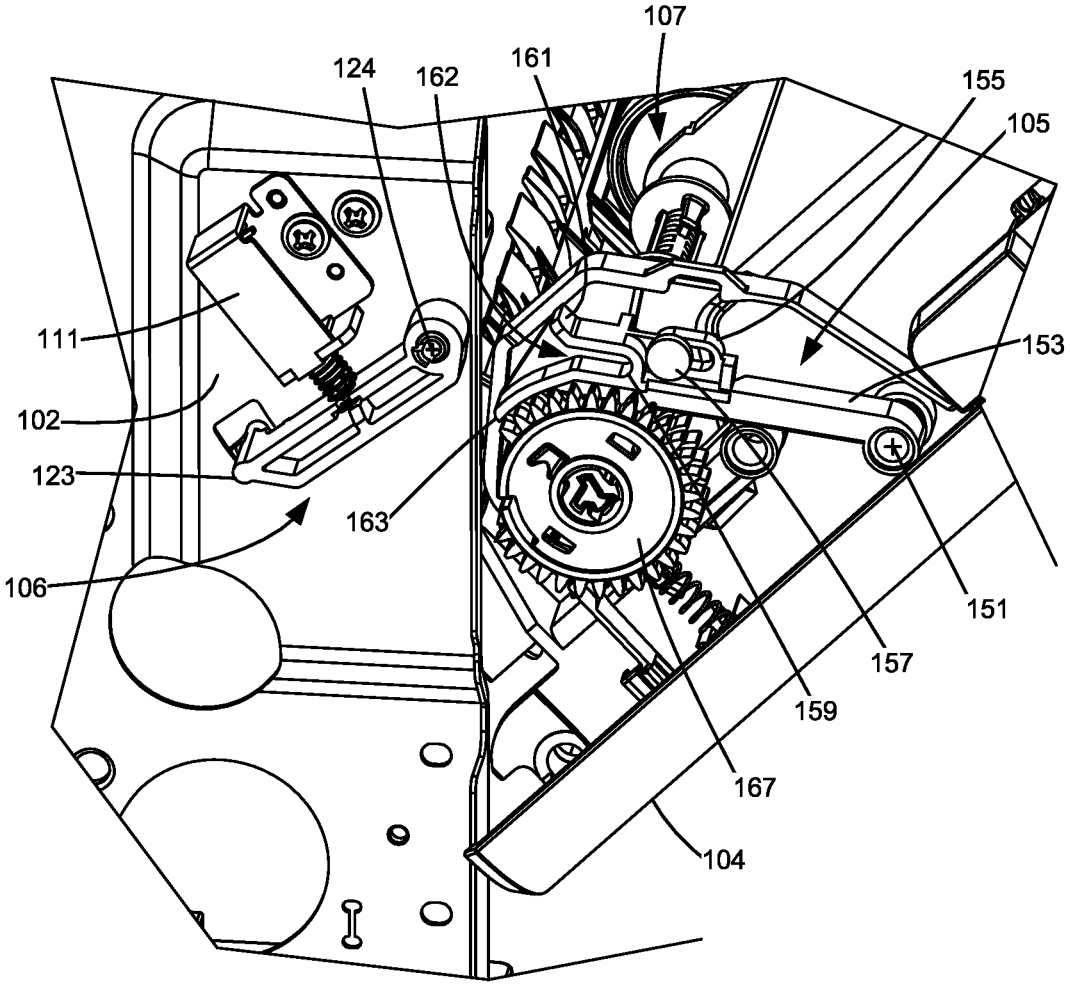

FIG. 1A shows a close up of the open door and associated printer mechanisms.

Figure 1B:
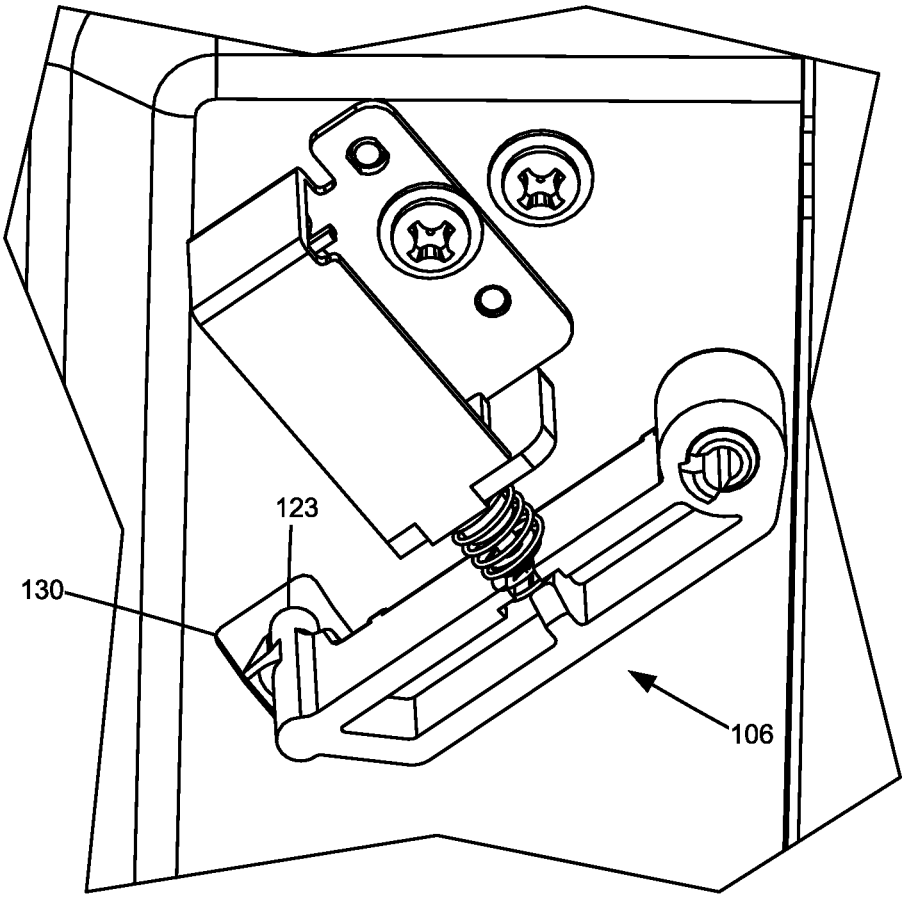

FIG. 1B shows the lever and wall window.

Figure 1C:
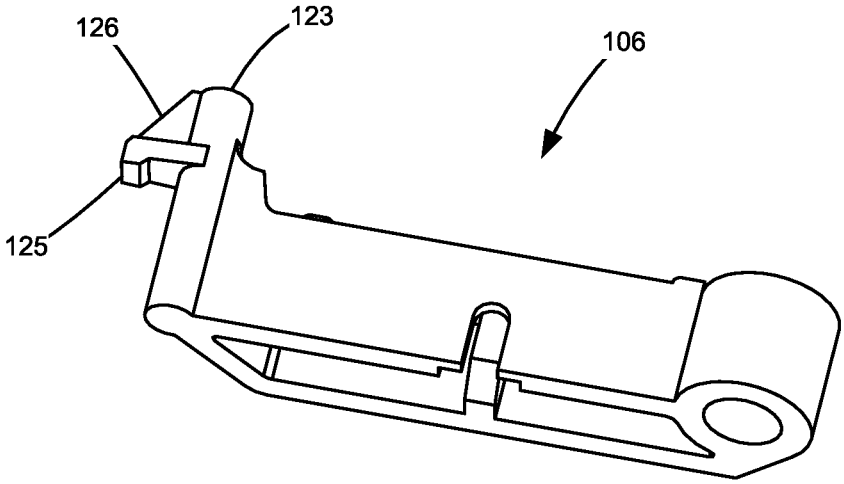

FIG. 1C shows the lever element.

Figure 1D:
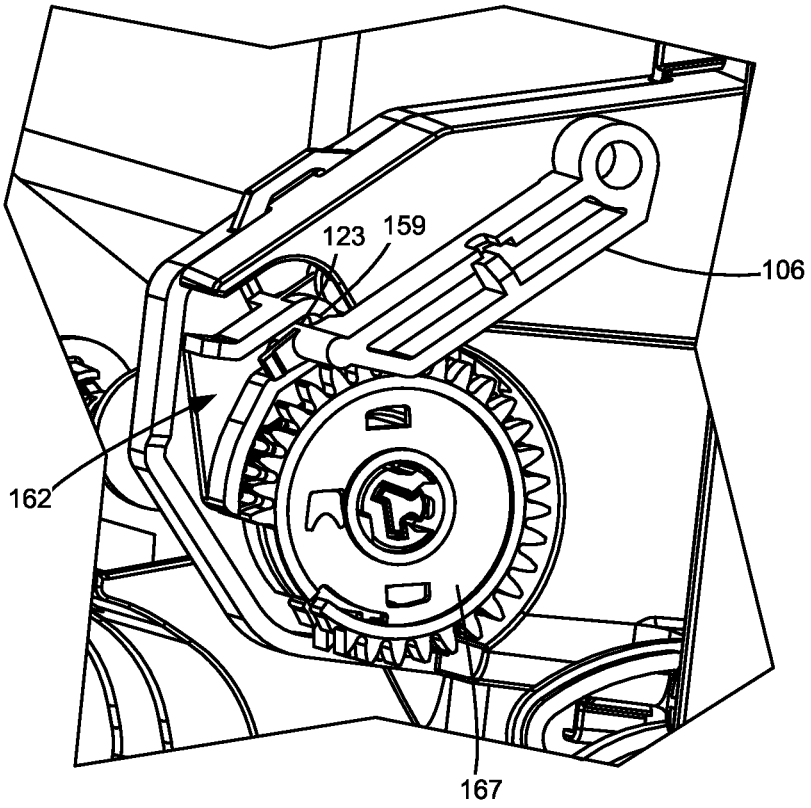

FIG. 1D shows the engagement of the lever and pawl funnel with the wall and solenoid removed for clarity.

Figure 2:
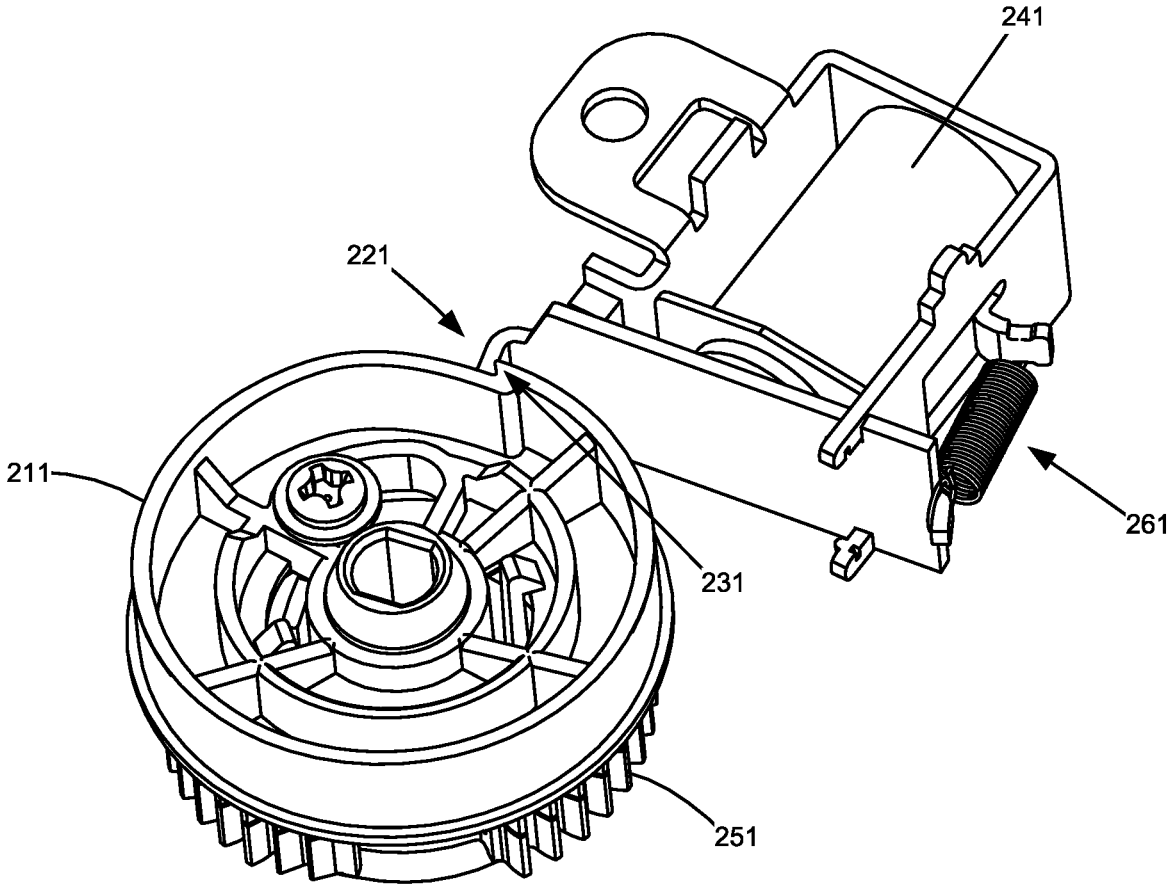
FIG. 2 (PRIOR ART)

FIG. 2 shows a dual sector gear clutch.

Figure 3:
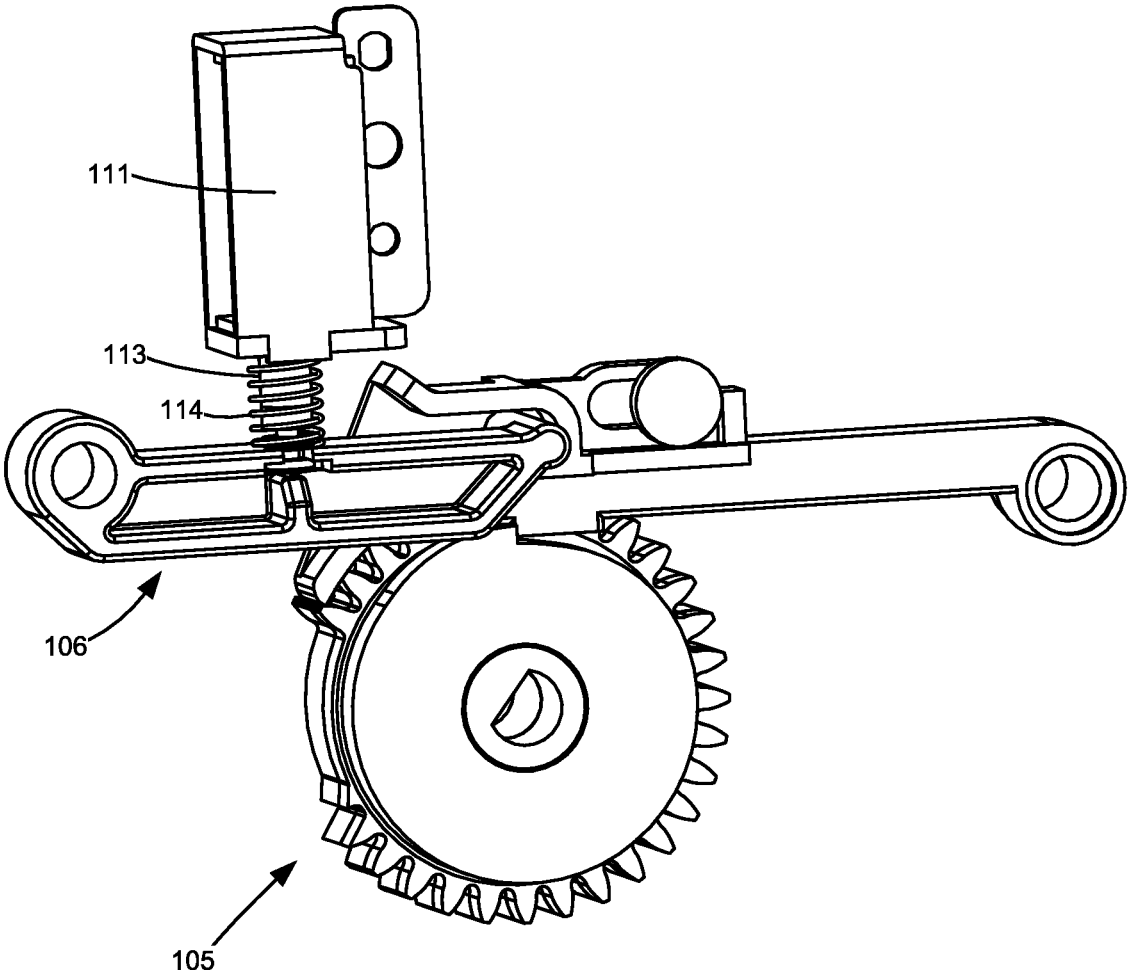

FIG. 3 shows a gear clutch that can be decoupled from the actuating solenoid.

Figure 4:
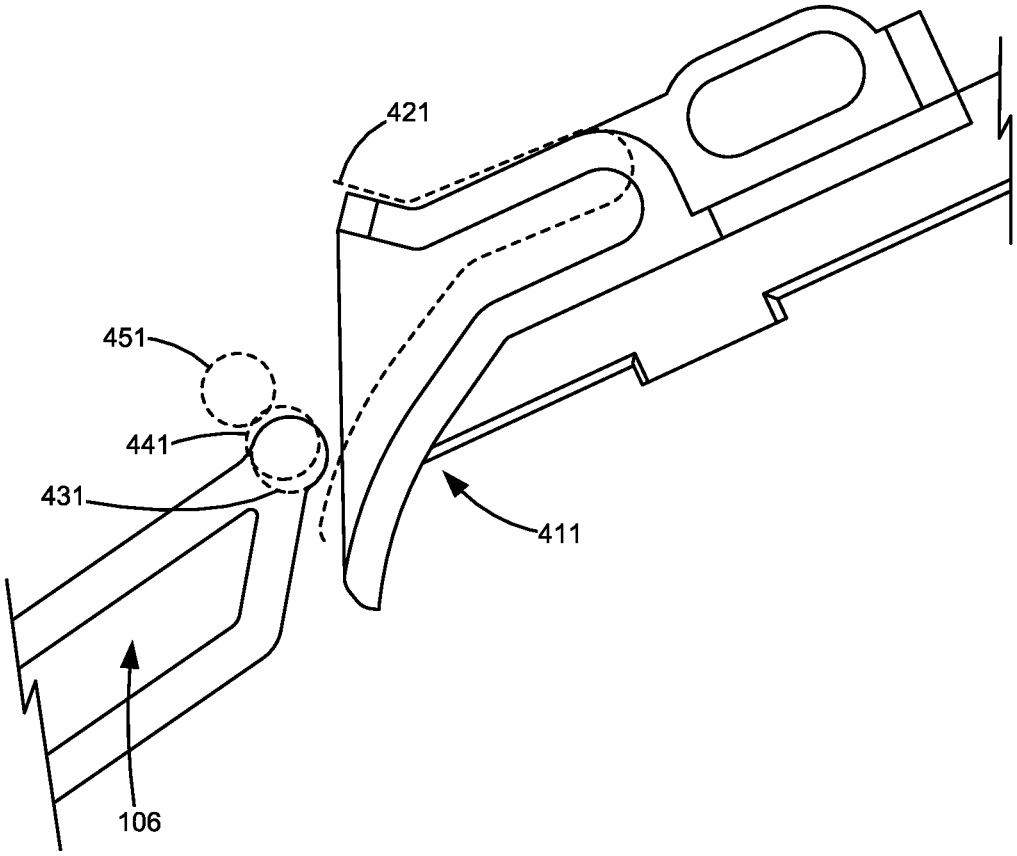

FIG. 4 shows the range of relative post and pawl positions when the door is closing.

Figure 5A:
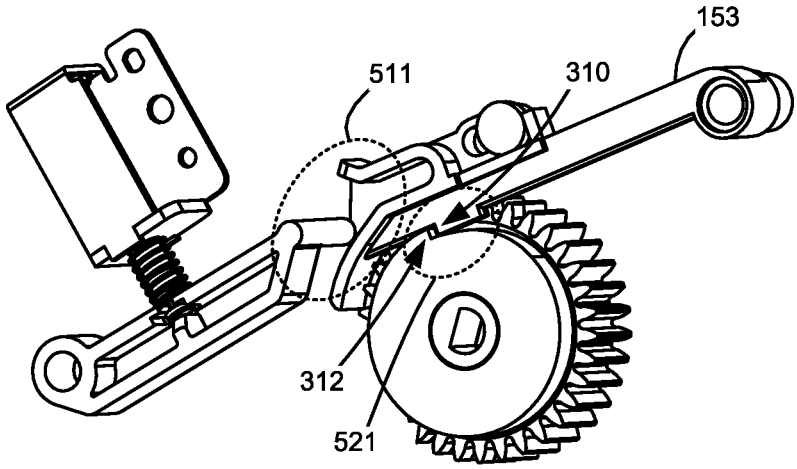

FIG. 5A shows the position of the pawl-actuating post and the pawl slot when the door is closing, the pawl-actuating pin is nearing the pawl slot, and the pawl is in the home position.

Figure 5B:
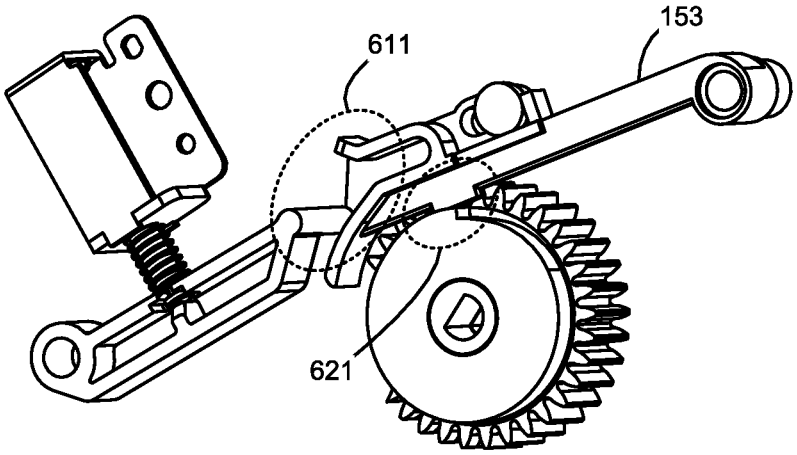

FIG. 5B shows the position of the pawl-actuating post and the pawl slot when the door is closing, the pawl-actuating pin is nearing the pawl slot, and the pawl is popped up out of the home position.

Figure 5C:
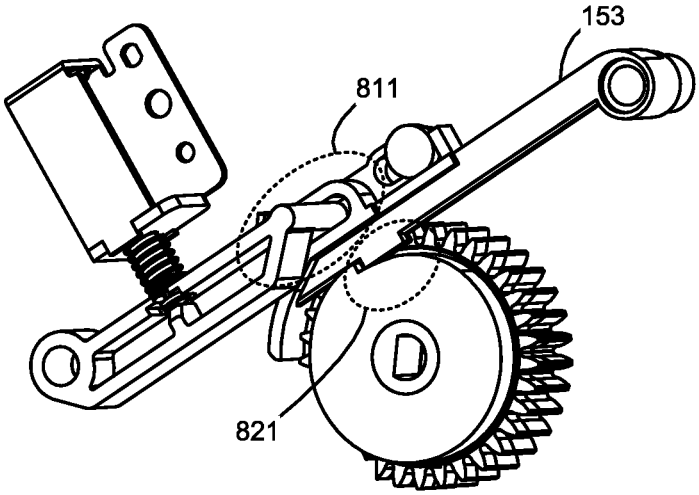

FIG. 5C shows the position of the pawl-actuating post and the pawl slot when the door is closed and the pawl is in home position.

Figure 5D:
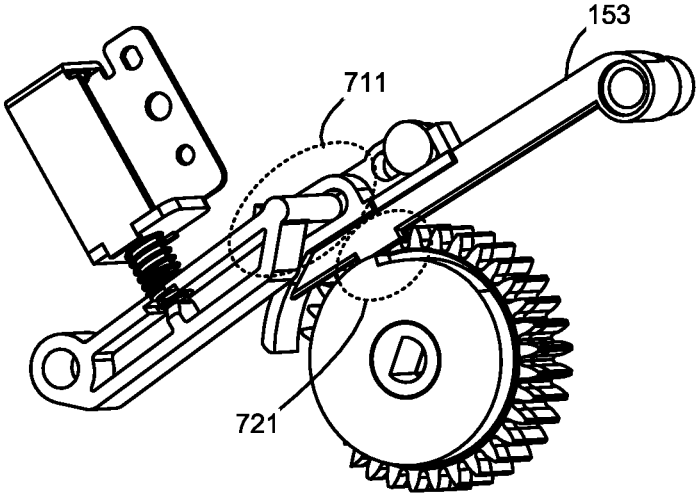

FIG. 5D shows the position of the pawl-actuating post and the pawl slot when the door is closed and the pawl is in an up-position out of the home position.

Figure 6A:
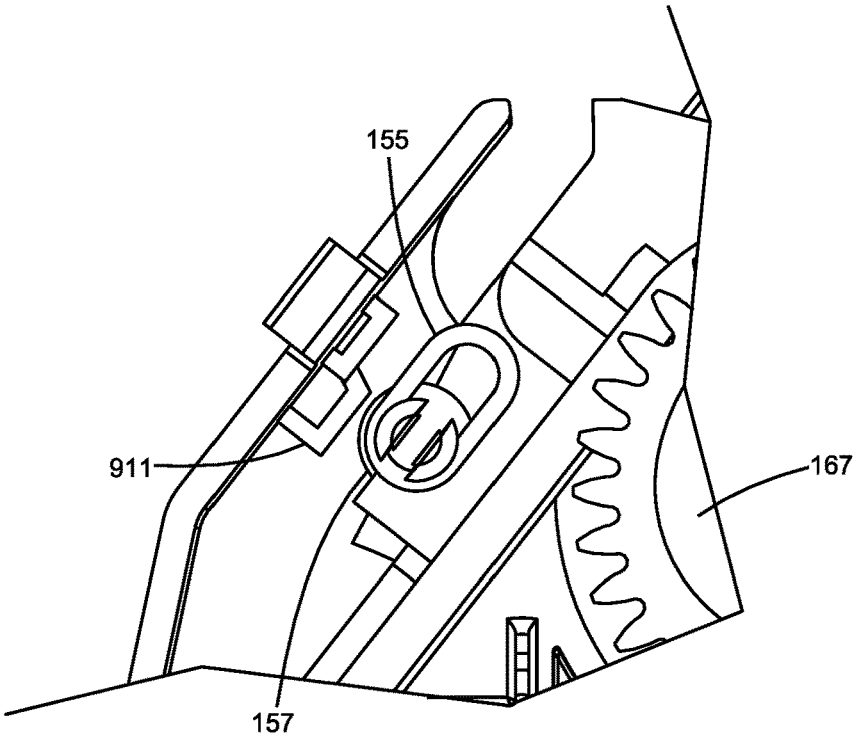

FIG. 6A shows the roller position when the door is open.

Figure 6B:
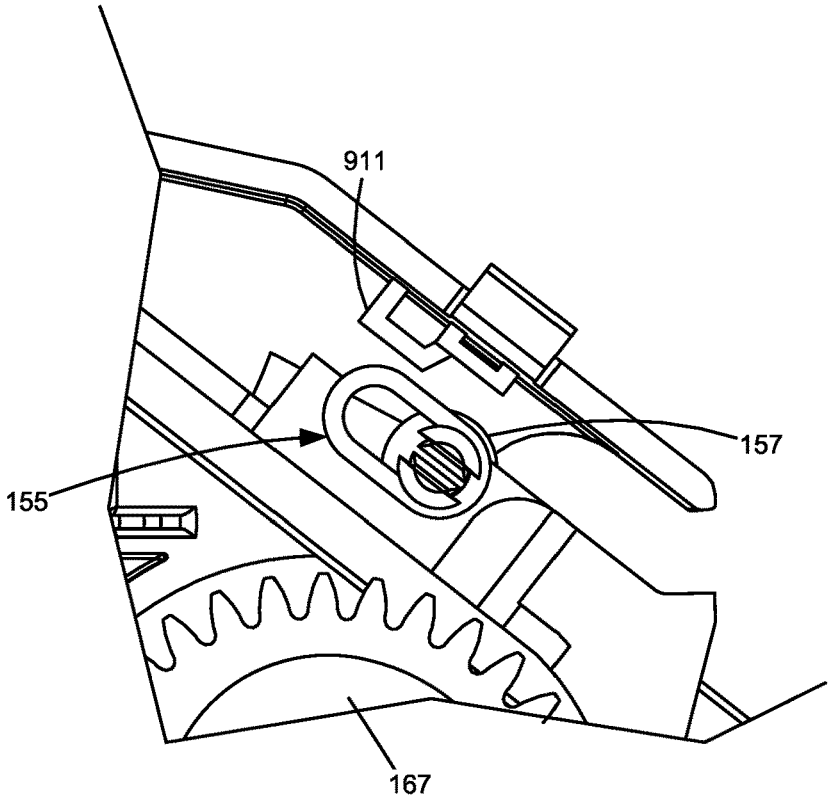

FIG. 6B shows the roller position when the door is closed.

Figure 7:
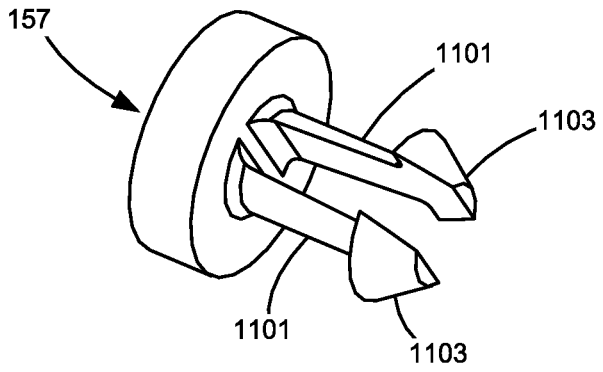

FIG. 7 shows the roller with snap features and flanges.

Figure 8:
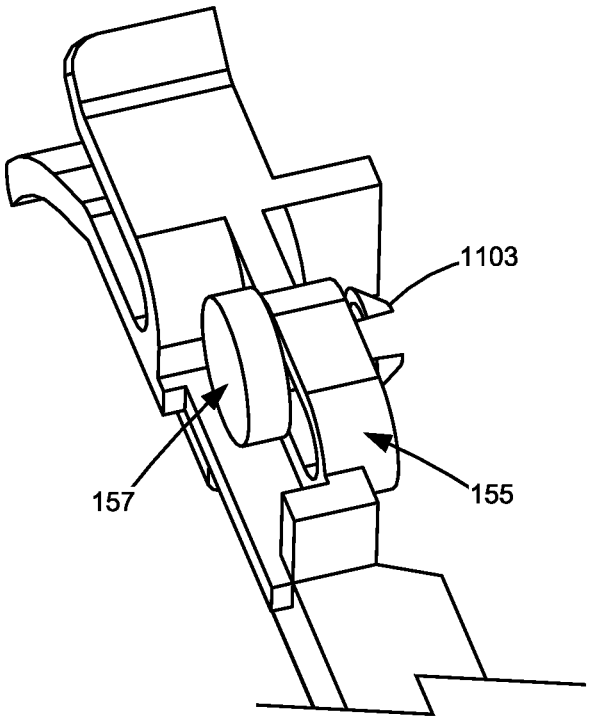

FIG. 8 shows the roller positioned in the pawl.

DETAILED DESCRIPTION

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology, terminology and dimensions used herein is for the purpose of description and should not be regarded as limiting. As used herein, the terms "having," "containing," "including," "comprising," and the like are open ended terms that indicate the presence of stated elements or features, but do not preclude additional elements or features. The articles "a," "an," and "the" are intended to include the plural as well as the singular, unless the context clearly indicates otherwise. The use of "including," "comprising," or "having" and variations thereof herein is meant to encompass the items listed thereafter and equivalents thereof as well as additional items. Terms such as "about" and the like are used to describe various characteristics of an object, and such terms have their ordinary and customary meaning to persons of ordinary skill in the pertinent art. The dimensions of the magnetic particles, separations between particles and sensor locations are interrelated and can be proportionally scaled with respect to each other to provide different sized solutions.

The present invention is described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

This invention reduces printer height to save cost on frames, covers, packaging, and shipping. One of the factors driving printer height is the multi-purpose feeder ("MPF") pick roll, which sits above the paper path. The toner cartridge extraction path must clear the MPF pick roll, which requires raising the laser scan unit ("LSU") and top cover to make room for the path. To achieve the height reduction, the MPF pick roll is moved onto the front door so that it swings out of the way of the cartridge path. The cartridge can take a more horizontal path, and so the printer height is reduced.

The challenge in moving the MPF pick roll to the door was the placement of the solenoid that actuates the pawl, which locks the MPF pick roll clutch. This invention allows the solenoid to stay mounted on the door frame of the printer so that no cables must be routed into the front door, which facilitates assembly and servicing. The invention allows, for example, a very low-cost solenoid to be used while still absorbing positional tolerance between the solenoid and MPF pick clutch. The invention also solves the problem of exposing the pick clutch to the user, where the user might inadvertently make the pick roll lose its home position.

The invention describes a cost-effective means of decoupling a single-revolution, pawl-actuated clutch from its actuating solenoid, so the clutch can be mounted on the door while the solenoid is mounted on the frame.

To realize this objective, a lever attached to the frame-mounted solenoid has a pawl-actuating post that interfaces with a flared slot on the door-mounted pawl of the clutch. This enables a low-cost solenoid in three ways: (1) the tolerances between the decoupled modules are absorbed and the interface can be recoupled regardless of pawl position when the door is closed, which reduces the range of motion requirement of the solenoid; (2) the pawl and lever are locked together bi-directionally by the slot, so no spring is needed directly on the pawl, which reduces the force requirement of the solenoid and eliminates the need for a spring directly on the pawl; and (3) a gravity-actuated roller locks the pawl in the down position when the door is opened to prevent loss of the clutch's home position when the pawl is released from the solenoid. If the home position were lost when the door is opened, the MPF would cycle when the door is closed, and the gear-train would be momentarily activated. This may result in either a dry pick of the MPF or feeding the top loaded sheet of the MPF, possibly causing a jam.

Decoupled Solenoid and Pawl

A printer 101 is shown in FIG. 1 with a door 104 in an open position. In FIG. 1A, a close-up view of the door 104 and associated printer mechanisms, including the multi-purpose feeder ("MPF") pick roll 107 and shaft 108.

This improved clutch design is superior to the dual sector gear clutch 211 shown in FIG. 2 that is used on several known printers. In the dual sector gear clutch 211, a pawl 221 interfaces with a cam 231 on the clutch 211 to hold the clutch in its home position, where it is not driven by its mating gear 251. When the pawl is momentarily pulled away from the cam by the solenoid 241 while a driving gear (not shown) is turning, the clutch makes a single rotation and stops at its home position again. The pawl 221 is typically released by solenoid 241 and returned by a spring 261.

In one embodiment of the invention described here shown in FIG. 1A, the actuating solenoid 111 is on one side of a printer wall 102 and connects to the pawl 153 by a lever component 106. The lever 106, which pivots about axis 124, has a pawl-actuating post 123 extending through a wall window 130 so that it may interface with a flared slot 162 on the clutch's pawl 153, which pivots about axis 151. The lever 106, post 123, and wall window 130 are shown in isolation in FIG. 1B. By extending the post 123 through the wall window 130, space is saved when the door 104 is closed because the solenoid 111 does not need to be on the inside of the wall 102.

The lever 106 is shown in FIG. 1C with a bearing point 125 that may abut the inside face of the wall 102, and a stabilizing element 126 for the bearing point 125. In FIG. 1D, the engagement of the lever 106 and pawl funnel 162, where the post 123 is in the pawl catch 159, is shown without the wall 102, wall window 130, of solenoid 111 to better visualize the interaction of the elements.

In the alternate embodiment, the solenoid 111 connects to the pawl 153 through a lever component 106. The lever 106 and solenoid 111 are mounted on the frame 102 of the printer 101. The lever 106 has a pawl-actuating post 123 that interfaces with a flared slot 162 on the clutch's pawl 153. The lever 106 magnifies the range of motion of the solenoid pin 113 to its pawl-actuating post 123. This enables a low-cost solenoid with low range of motion.

A person of ordinary skill in the art would recognize further embodiments where the lever 106 and pawl 153 could be on the same side of the wall 102, in either orientation identified above.

In any of these embodiments, the clutch 105 shown in FIG. 3, for example, is decoupled from the actuating solenoid 111 when the door 104 with the pick mechanism 107 is opened. This enables the pick mechanism to be pulled out of the way of the cartridge path (not shown) in a compact printer design, while avoiding mounting the solenoid on the door with the clutch.

Solenoids with low-end cost have a short stroke distance and low pull force. The invention accommodates these limitations, despite the large number of part dimensions that contribute to the relative positions between the parts on the frame and the parts on the door.

When the door 104 is shut, the pawl-actuating post 123 is trapped in the slot of the pawl 162, directly over the pawl's cam catch feature, or pawl notch, 310. Therefore, the pin 113 and spring 114 on the solenoid 111 control both the lever 106 and the pawl 153 in both directions, and no additional spring is required on the pawl 153, which would increase the solenoid pull force requirement. Positioning the pin 113 on the same line from the gear 167 center as the pawl catch 159 causes lateral dimensional tolerances to be negligible, so long as the pawl has a long moment arm.

The solenoid 111 connects to the pawl 153 through a lever component 106. The lever 106 and solenoid 111 are mounted on the frame 102 of the printer 101. The lever 106 has a pawl-actuating post 123 that interfaces with a flared slot 162 on the clutch's pawl 153. The lever 106 magnifies the range of motion of the solenoid pin 113 to its pawl-actuating post 123. This enables a low-cost solenoid with low range of motion.

Solenoids with low-end cost have a short stroke distance and low pull force. The invention accommodates these limitations, despite the large number of part dimensions that contribute to the relative positions between the parts on the frame and the parts on the door.

When the door 104 is shut, the pawl-actuating post 123 is trapped in the slot of the pawl 162, directly over the pawl's cam catch feature, or pawl notch, 310. Therefore, the pin 113 and spring 114 on the solenoid 111 control both the lever 106 and the pawl 153 in both directions, and no additional spring is required on the pawl 153, which would increase the solenoid pull force requirement. Positioning the pin 113 on the same line from the gear 167 center as the pawl catch 159 causes lateral dimensional tolerances to be negligible, so long as the pawl has a long moment arm.

A typical solenoid specification gives a pull strength at a given stroke distance of the pin. All the components are arranged so that if all the dimensions are at the worst case of their tolerance ranges in the door-closed position (FIG. 4, discussed below), the pin is still within its specified stroke distance. This guarantees a minimum pull force. This pull force must overcome the spring on the pin and the friction at the pawl's interface to the cam (which is minimal). Designing for this worst case means the nominal stroke distance is very small, due to the number of part dimensions between the module on the frame and the module on the door.

The lever allows this small stroke distance of the pin to be magnified enough to ensure the pawl is lifted far enough to disengage, even if all the relational part dimensions are at the worst-case limits of their tolerance ranges.

Aligning the Post and Slot

The pawl-actuating post 123 and the slot 162 must be mated when the door 104 closes. The pawl 153 may be offset from the post 123 position, and the pawl 153 may possibly be stuck up in the disengaged position if the door 104 was opened during a print job or the pick roll 107 was rotated during jam clearance. Shown in FIG. 4 is the range of relative post and pawl positions when door is almost closed. In FIG. 4, the home position 411 for the pawl shown along with the high position 421 of the pawl while the door 104 is closing. The home positioned 411 referenced occurs when the pawl notch 310 and the cam on the clutch, or gear notch, 312 abut as shown in FIG. 3. Also shown in FIG. 4 is the post 123 in the door-open rest position 431, the post 123 location in operating position home 441, and the post 123 location when in operating position 451, and the pawl 153 is retracted.

The strategy used to align the post 123 and pawl 153 is to allow the lever and post to rest at a known low position 431, just low enough to ensure it can match the pawl slot 162 position when the pawl is at the home position 411. When the door 104 is closed, the post 123 will be caught by the funnel 163 at the entrance to the slot 162 and pulled up to meet the slot, wherever it is (compare FIGS. 5C and 5D discussed below).

Shown in FIGS. 5A, 5B, 5C, and 5D are the various relative positions of the post 123 and the pawl slot 162. FIG. 5A shows the position of the pawl-actuating post and the pawl slot when the door 104 is closing, the pawl-actuating pin 123 is nearing the pawl slot 162 (shown as 511), and the pawl 153 is in the home position 521. The home position occurs when the pawl notch 310 and the gear notch 312 abut.

FIG. 5B shows the position of the pawl-actuating post 123 and the pawl slot 162 when the door 104 is closing, the pawl-actuating pin 123 is nearing the pawl slot 162 (shown as 611), and the pawl 153 is popped up out of the home position (shown as 621). Here, printer the gear train (not shown) momentarily rotates when the door is first closed, and this allows the clutch 167 to rotate forward to its home position 521 if necessary, and the pawl 105 and lever 106 will drop into position.

FIG. 5C shows the position of the pawl-actuating post 123 and the pawl slot 162 (shown as 711) when the door 104 is closed and the pawl 105 is in home position 721.

FIG. 5D shows the position of the pawl-actuating post 123 and the pawl slot 162, where the relative position of the post 123 in the pawl catch 159 at the back of the slot is shown as 511, when the door is closing and the pawl 105 is in an up-position out of the home position 821. Here also, printer the gear train (not shown) momentarily rotates when the door is first closed, and this allows the clutch 167 to rotate forward to its home position 521 if necessary, and the pawl 105 and lever 106 will drop into position.

Since the lever is known to be at a low position 431 when the door 104 is closing, the funnel 163 on the flared slot only needs a bottom side. It reaches low enough to catch the post 123 even if the pawl is stuck in the high disengaged position 421. This arrangement minimizes how much the pawl protrudes away from the gear.

Locking the Pawl

When the door is open, the pawl is partially exposed to the user. It must stand up to vibrations or minor manipulation by the user that might disengage it and make the MPF pick roll lose its home position. If the home position is lost, the pick roll must be rotated back to home when the door is closed, which may cause either an unwanted dry pick (which results in wear on the roll and separator pad) or an unwanted pick of the top sheet in the tray.

FIGS. 6A and 6B shows the positions of a roller 157 that is free to roll along the top of the pawl in the slot 155. Gravity pulls the roller 157 to either end of its range of motion, depending on the open or closed orientation of the door. In the door-open position shown in FIG. 6A, the roller is trapped from above by a wall trap feature 911 in the door 104 that prevents the pawl 105 and associated the pawl notch 310 from moving far enough to disengage the gear notch 312, or cam. When the door is closed shown in FIG. 6B, the roller 157 is no longer aligned with the wall trap feature 911, and the pawl 105 and associated the pawl notch 310 can move far enough to disengage the gear notch 312.

The roller 157 shown in FIG. 7 has loose snap features 1101 with flanges 1103 on the end serve to hold the parts together during assembly before the roller 157 is positioned as shown in FIG. 8.

If the door is opened during a print job or after a paper jam, the gear notch or cam 312 may not be aligned with the home position, and the pawl may be in a raised position as shown in FIG. 5D. In this case, the roller 157 will not function to lock the pawl. Although it is undesirable for the home position to be lost, it cannot be avoided in these cases.

The MPF pick roll system traditionally sits above the front paper guide and contributes to the difficulty of clearing jams at the front of the printer. But with the pick roll system moved to the door, an opportunity was identified to move the front paper guide out of the way of jam clearance by also placing the paper guide on the front door. When the door is opened to clear a jam, the front guide comes with it, exposing the paper at the front and allowing it to be pulled naturally toward the user, instead of away.

We claim:

1. A solenoid and a pawl for a door-mounted multi-purpose feeder of a printer comprising:

a gear clutch;

the pawl interfaces with a cam on the clutch to hold the clutch in its home position; and the solenoid that connects to the pawl through a lever component, wherein the clutch is decoupled from the solenoid when a door with the multi-purpose feeder pick is opened, further comprising an opening in a first side of a wall of the printer, wherein the solenoid is attached to the first side of the wall and connects to the pawl through the lever component with a pawl-actuating pin that extends through the opening to the pawl that is positioned on or at a distance from a second side of the wall.

2. The solenoid and the pawl of claim 1, further comprising a roller and a wall trap feature in the door that prevents the pawl from moving far enough to disengage from a home position when the door is opened.

3. A solenoid and a pawl for a door-mounted multi-purpose feeder of a printer comprising:

a gear clutch;

the pawl interfaces with a cam on the clutch to hold the clutch in its home position; and the solenoid connects to the pawl through a lever component, wherein the clutch is decoupled from the solenoid when a door with the multi-purpose feeder is opened, wherein the multi-purpose feeder may be pulled out of the way of a cartridge path in the printer, further comprising an opening in a first side of a wall of the printer, wherein the solenoid is attached to the first side of the wall and connects to the pawl through the lever component with a pawl-actuating pin that extends through the opening to the pawl that is positioned on or at a distance from a second side of the wall.

4. The solenoid and pawl of claim 3, further comprising a roller and a wall trap feature in the door that prevents the pawl from moving far enough to disengage from a home position when the door is opened.

5. A solenoid and a pawl for a door-mounted multi-purpose feeder of a printer comprising:

a gear clutch;

the pawl interfaces with a cam on the clutch to hold the clutch in its home position;

the solenoid mounted on a first side of a wall of the printer; and an opening in the first side of the wall of the printer, wherein the solenoid connects to the pawl through a lever component with a pawl-actuating pin that extends through the opening to the pawl that is on a second side of the wall, further wherein the clutch is decoupled from the solenoid when a door with the multi-purpose feeder pick is opened to allow the multi-purpose feeder to be pulled out of the way of a cartridge path in the printer.

6. The solenoid and pawl of claim 5, further comprising a roller and a wall trap feature in the door that prevents the pawl from moving far enough to disengage from a home position when the door is opened.

* * * * *